US005495860A

United States Patent [19]

Teufel et al.

[11] Patent Number: 5,495,860

[45] Date of Patent: Mar. 5, 1996

[54] STRUCTURES FORMED FROM CELLULOSE ACETATE, USE THEREOF FOR THE MANUFACTURE OF FILTER TOW, USE OF THE FILTER TOW FOR THE MANUFACTURE OF A TOBACCO SMOKE FILTER ELEMENT, AS WELL AS A FILTER TOW AND A TOBACCO FILTER ELEMENT

[75] Inventors: Eberhard Teufel, Gundelfingen; Rolf Willmund, Emmendingen, both of Germany

[73] Assignee: Rhone-Poulenc Rhodia AG, Freiburg, Germany

[21] Appl. No.: 94,563

[22] Filed: Jul. 20, 1993

[30] Foreign Application Priority Data

Jul. 9, 1993 [DE] Germany ..... 43 22 966.2

[51] Int. Cl.[6] ..... A24D 3/10

[52] U.S. Cl. ..... 131/331; 131/345; 493/39

[58] Field of Search ..... 131/331, 332, 131/345; 106/163.1, 184, 196; 95/285; 493/39, 49, 50; 536/69

[56] References Cited

U.S. PATENT DOCUMENTS

| | | | |
|---|---|---|---|
| 1,528,291 | 3/1925 | Dreyfus | 106/196 |
| 2,688,380 | 9/1954 | MacHenry . | |
| 3,368,566 | 2/1968 | Avedikian | 131/344 X |
| 3,543,769 | 12/1970 | Arthur et al. | 131/345 |
| 3,898,986 | 8/1975 | Zaffaroni . | |
| 4,180,536 | 12/1979 | Howell et al. | 131/345 X |
| 4,281,671 | 8/1981 | Bynre et al. | 493/49 X |
| 4,283,186 | 8/1981 | Keith et al. | 131/345 X |
| 4,292,984 | 10/1981 | Sawada et al. | 131/345 |
| 4,366,826 | 1/1983 | Horsewell | 131/345 X |
| 5,246,017 | 9/1993 | Saintsing et al. | 131/335 |

*Primary Examiner*—Jennifer Bahr
*Attorney, Agent, or Firm*—Bucknam and Archer

[57] ABSTRACT

Structures are formed from cellulose acetate in which an additive is present or on this surface the additive consisting of a nitrogenous organic compound which by degradation by microorganisms forms basic decomposition products, in particular ammonia, and/or—basic—compounds having an NH group or NH groups and/or an $NH_2$ group or $NH_2$ groups. The structures may have the form of filaments, staple fibers, films, foils, sheets or other objects. The structures in the form of filaments and/or staple fibers are used for the manufacture of filter tows. The filter tow of this kind is described. The filter tow is for the manufacture of a tobacco smoke filter element, and such a tobacco smoke filter element is described. The structures, the filter tow, and the tobacco smoke filter element according to the invention show improved biodegradation under the action of environmental influences, the filter tow and the tobacco smoke filter element being capable of being stored under the conditions customarily used today without danger of microbiological degradation.

21 Claims, No Drawings

STRUCTURES FORMED FROM CELLULOSE ACETATE, USE THEREOF FOR THE MANUFACTURE OF FILTER TOW, USE OF THE FILTER TOW FOR THE MANUFACTURE OF A TOBACCO SMOKE FILTER ELEMENT, AS WELL AS A FILTER TOW AND A TOBACCO FILTER ELEMENT

FIELD OF THE INVENTION

The present invention relates to structures formed from cellulose acetate in which, or on the surface of which, an additive is present.

This invention further relates to the use of structures formed from cellulose acetate in the form of filaments and/or staple fibers for the manufacture of filter tow.

This invention also relates to a filter tow.

Further, the invention relates to the use of a filter tow for the manufacture of a tobacco smoke filter element.

Finally, the invention relates to a tobacco smoke filter element consisting of a section of a transverse-axially compacted filter tow of cellulose acetate filaments and/or cellulose acetate staple fibers hardened by means of a cellulose acetate plasticizer or an adhesive.

BACKGROUND OF THE INVENTION

Cigarette filters disintegrate relatively slowly and therefore are an annoyance to broad sections of the population in places where there is much smoking.

For most cigarette filters, cellulose acetate fibers are being used today having an acetyl number between 53 and 57% (cf. for example U.S. Pat. No. 2,953,837. The numerical values cited in this patent, namely 38% to 41% for the acetyl content, correspond to the aforesaid values of 53 to 57% for the acetyl number).

Compared with other polymers, in particular synthetic ones, such a cellulose acetate is indeed biodegradable, but the time spans after which cigarette filters of such fibers have disappeared at least optically under the action of environmental influences are too long in today's estimation.

Similarly to the cigarette filters, this applies also to other structures of cellulose acetate, such as films, foils, sheets or other objects of cellulose acetate obtained for example by injection molding, extruding or blow-molding: when such structures are stored for example in dumps, it takes too long until these structures are completely biodegraded.

Filter tows and tobacco smoke filter elements of cellulose acetate fibers, on the surface of which an additive is provided, are known for example from German Patent 1079521. According to this German Patent 1079521, the additive applied on the surface of the cellulose acetate fibers serves to improve the roughness of these fibers. However, no suggestion can be found in German Patent 1079521 for the acceleration of the biodegradability of the filter tows and of the tobacco smoke filter elements.

Further, U.S. Pat. No. 5,141,006 describes filter tows and tobacco smoke filter elements of cellulose acetate fibers in which an additive is present. According to U.S. Pat. No. 5,141,006, with the additive in the cellulose acetate fibers in particular the filter efficiency for nicotine is to be improved. However, also U.S. Pat. No. 5,141,006 gives no indication of the possibility to accelerate the biodegradability of the filter tow and of the tobacco smoke filter elements.

German patent application 40 13 293 and German patent application 40 13 304 do indeed describe cigarette filters which under the action of environmental influences decompose relatively fast, but these cigarette filters consist of a section of transverse-axially compacted fiber skeins of fibers of spun PHB (polyhydroxybutyric acid) or a copolymer of PHB and PHV (polyhydroxyvalerc acid). These polymers, however, are not at present being used for the manufacture of filter tow and tobacco smoke filter elements, at least not to any appreciable extent, which may be due to

- the insufficient industrial availability of the polymers.
- the effect on the taste of the smoke different from cellulose acetate and
- as yet unclarified process technological problems in the processing of such polymers to filter tows and tobacco smoke filter elements (for example in connection with the hardening of such tobacco smoke filter elements or in connection with the use of problematic solvents in spinning threads from these polymers).

Finally from German patent application 39 14 022 new plastic materials are known which are easily biodegradable by composting and their use for the manufacture of sheaths/containers for oil lamps, eternal light oil candles, composition oil lamps, other grave lamp models, sacrificial lamps and foils is known. As plastic materials there is cited in German patent application 39 14 022 a plastic material on the basis of e.g. cellulose acetate with additives such as citric acid esters, polyester, phosphoric acid esters and organic iron compounds. As organic iron compounds there may be used for example ferrocenes, i.e. derivatives of bis-(cyclopentadienyl)-iron or iron (II) acetylacetonate.

However, the plastic materials described in German patent application 39 14 022 are hardly suitable or unsuitable for the manufacture of mass-produced articles, because

- the required quantity of said additives is very high, and this, by the way, considerably limits the possibilities of use of such plastic materials, and
- due to their high price, the mentioned additives greatly increase the cost of the objects made from the described plastic materials. An additional factor is that for some of the additives described in German disclosure 39 14 022, approval under food legislation or approval under TVO (Tobacco Ordinance) is not possible or hardly possible, both because of the required quantities and because of their toxicity, thus making impossible the use of the plastic materials described in German disclosure 30 14 022 for e.g. filter tows and tobacco smoke filter elements, such as cigarette filters. In addition, no hint to the possibility of accelerating the biodegradation of filter tows and tobacco smoke filter elements can be found in German patent application 39 14 022; nor would the formulation described in German disclosure 39 14 022 be suitable for the manufacture of filter tows and tobacco smoke filter elements because of the overly high proportion of plasticizer in the cellulose acetate.

A summary of the prior art shows, therefore, that

- for mass-produced articles of cellulose acetate there is still a need to make them better biodegradable and
- also for structures from cellulose acetate which are governed by the food law and/or the tobacco ordinance, such as filter tows consisting of cellulose acetate fiber material, as well as tobacco smoke filter elements made from such a filter tow, no solution to accelerate their biodegradation is known as yet.

SUMMARY OF THE INVENTION

It is therefore the object of the invention to make available structures formed from cellulose acetate, in particular such structures suitable as a mass-produced article or governed by the food law and the tobacco ordinance, which show improved biodegradation under the action of environmental influences.

Another object of the invention is to propose the use of structures formed from cellulose acetate in the form of filaments and/or staple fibers for the manufacture of filter tow of improved biodegradation under the action of environmental influences as well as the use of such a filter tow for the manufacture of a tobacco smoke filter element also with improved biodegradation under the action of environmental influences.

It is still another object of the invention to make available a filter tow on the basis of structures formed from cellulose acetate in the form of filaments and/or staple fibers as well as a tobacco smoke filter element made from such a filter tow, which show improved biodegradation under the action of environmental influences.

As to the structures formed from cellulose acetate, the problem is solved by structures formed from cellulose acetate in which or on the surface of which an additive is present, which are characterized in that the additive consists of a nitrogenous organic compound, upon the degradation of which by microorganisms basic decomposition products, in particular ammonia, and/or—basic— compounds having an NH group or NH groups and/or an $NH_2$ group or $NH_2$ groups, are formed.

Preferred is the nitrogenous organic compound urea, or a urea derivative. These substances are preferred because they are unobjectionable under the food law and are available in large amounts and at an acceptable price.

Preferably the nitrogenous organic compound also consists of a protein, special preference being given to beta-lactoglobulin. Proteins, too, are not objectionable under the food law, and for beta-lactoglobulin the fact is that in cheese-making it is obtained in large amounts as a by-product little utilized industrially.

Further it is preferred for the nitrogenous organic compound to use a condensation product from an aldehyde with ammonia or with an amine, this condensation product being most preferably hexamethylene tetramine.

Finally it is preferred for the nitrogenous organic compound to use a cyclic compound, in particular carbazole (=dibenzopyrrole, diphenyleneimide).

Naturally, also other nitrogenous organic compounds may be used, but they should., to the extent possible, not be toxic.

It is advantageous further to have another biodegradable additive present in the structures formed from cellulose acetate.

Further it is advantageous that the structures formed from cellulose acetate consist of an acetone-soluble cellulose acetate having an acetyl number of less than 53%, preferably an acetyl number between 50 and 52%. This feature brings it about that the hydrolysis of the cellulose acetate preceding the biodegradation occurs in a shorter time.

In addition, it is advantageous that the structures formed from cellulose acetate have the form of filaments, staple fibers, films, foils, sheets or other objects obtained by injection molding, extrusion or blow-molding; naturally the structures formed from cellulose acetate may also have been obtained by means of other shaping methods.

Preferably the tear strength of the filter tow, referred to the total titer, is at most $4\times10^{-4}$ daN/dtex, preferably at most $3\times10^{-4}$ daN/dtex. By this characteristic the mechanical comminution preceding the biodegradation is facilitated.

For the tobacco smoke filter element of the invention it is preferred that the cellulose acetate plasticizer be biodegradable and/or that it accelerate the microbiological growth on the cellulose acetate filaments and staple fibers or that the adhesive be water-soluble and/or biodegradable, it being most preferred that the adhesive be a starch glue or a polyvinyl acetate glue.

By the use of a water-soluble and/or biodegradable adhesive it is achieved that the mechanical comminution of the tobacco smoke filter element preceding the biodegradation is facilitated.

Further it is preferred that the tobacco smoke filter element contains the cellulose acetate plasticizer in a quantity of at most 6 mass-% referred to the mass of the cellulose acetate filaments and/or to the mass of the cellulose acetate staple fibers. Although with this feature a certain reduction in the hardness of the tobacco smoke filter element is accepted, one achieves as a result again easier mechanical comminution of the tobacco smoke filter element preceding the biodegradation.

Finally it is preferred for the tobacco smoke filter element of the invention that less than one-half the surface of the cellulose acetate filaments and staple fibers be provided with the cellulose acetate plasticizer or with the adhesive. This, too, facilitates the mechanical comminution of the tobacco smoke filter element preceding the biodegradation.

As plasticizer for the cellulose acetate, triacetin is preferably used according to the invention, but other plasticizers, such as triethylene glycol diacetate, may be used as well.

If the structures according to the invention are present in the form of filaments or fibers, it is preferred that the nitrogenous organic compound be either soluble in acetone or dispersible in acetone in such a way that it is co-extruded in the production of the filaments and hence is not separated into any appreciable extent during the filtration preceding the spinning process.

According to the invention, the additive consists of a nitrogenous organic compound. Naturally this means also that the additive may consist of several nitrogenous organic compounds, that is, a mixture of several nitrogenous organic compounds within the scope of the invention may be used.

The principle underlying the invention is that due to the biodegradation of the nitrogenous organic compound and the resulting basic decomposition products, there is produced on the surface of the structures formed from cellulose acetate a basic (alkaline) medium which brings about a partial hydrolysis of the cellulose acetate (concerning the decomposition of nitrogenous native substances cf. G. Schlegel, Allgefmeine Mikrobiologie, 6th revised edition with the collaboration of Karin Schmidt, 1985, Georg Thieme Verlag Stuttgart-New York, pages 430 ff).

By a filter tow within the scope of the invention a band of a plurality of cellulose acetate filaments and/or staple fibers is to be understood (compare the definition of the term "filter tow" for example in German patent application 41 09 603)f. Preferably the filter tow of the invention is a band of a plurality of cellulose acetate filaments in which these filaments may be crimped, in particular in a crimping machine under pressure.

By the term "filament" is to be understood a practically endless fiber, and the term staple fiber" means a fiber of limited length (concerning these two definitions, see "Rompps Chemie-Lexikon", 8th revised and enlarged edition, Franckh'sche Verlagshandlung, W. Keller & Co., Stuttgart/1987, resp. Volume 2, page 1283, and Volume 5, page 3925—with reference to DIN 60 001 T2 of December 1974).

The tobacco smoke filter element according to the invention is preferably a cigarette filter, but it may also be a filter for cigars, cigarillos or tobacco pipes.

By acetyl number one understands within the scope of the invention the proportion of bound acetic acid in the cellulose acetate, expressed in mass-% (cf. Ullmann's Encyclopedia of Industrial Chemistry, Fifth, Completely Revised Edition, Volume A 5, pages f444 and 445—VCH Verlagsgesellschaft mbH, D-6940 Weinheim, Federal Republic of Germany, 1986).

The following advantages are achieved with the invention:

The new structures formed from cellulose acetate are suitable also for use as mass-produced article and as structures subject to the food law and/or the tobacco ordinance. In addition, the new structures formed from cellulose acetate are cheaper than the known structures formed from cellulose acetate.

The filter tow and the tobacco smoke filter element according to the invention show, as compared with the known filter tow and known tobacco smoke filter elements from cellulose acetate fiber material, an acceleration of the rotting rate under environmental influences; yet storage of the filter tow and of the tobacco smoke filter element according to the invention is readily possible under conditions customary today without the danger of microbiologic degradation.

With the invention one achieves not only an acceleration of the mechanical comminution of the structures formed from cellulose acetate by the microbiological degradation of the additive, but also an acceleration of the microbiological degradation of the cellulose acetate itself.

The manufacture of the filter tow according to the invention is effected essentially by Spinning cellulose acetate filaments by extruding a solution of cellulose acetate in acetone through a multi-hole spinneret and if necessary subsequently cutting of the cellulose acetate filaments to cellulose acetate staple fibers and gathering a plurality of the cellulose acetate filaments and/or staple fibers thus obtained to a filter tow.

To achieve the result that the additive (the nitrogenous organic compound or several of these compounds) be present in the cellulose acetate filaments and in the cellulose acetate staple fibers, this additive can be introduced into the above-mentioned solution of cellulose acetate in acetone, after which the latter is spun.

The manufacture of the tobacco smoke filter element according to the invention is effected essentially by providing the filter tow, consisting of cellulose acetate filaments and/or staple fibers, with a cellulose acetate plasticizer or an adhesive, subsequently transverse-axial compacting and if necessary wrapping the filter tow with a wrapping strip, cutting the filter tow thus compacted and if necessary wrapped into individual tobacco smoke filter rods, and finally cutting these filter rods into individual tobacco smoke filter elements.

To achieve the results that the additive (the nitrogenous organic compound or several of these compounds) be present on the surface of the cellulose acetate filaments and staple fibers, this additive can, be applied during the manufacture of the filter tow, but after the formation of the cellulose acetate filaments, onto these filaments or onto the cellulose acetate staple fibers formed therefrom (for example, the additive can be applied on the filaments immediately before the cutting of the cellulose acetate filaments into cellulose acetate staple fibers, or the additive can be applied on the finished filter tow, that is, after the gathering of the cellulose acetate filaments and/or staple fibers to a filter tow, on the filaments and/or staple fibers or be applied during the manufacture of the tobacco smoke filter element, but prior to the transverse-axial compacting of the filter tow, onto the cellulose acetate filaments and/or staple fibers (preferably the additive is applied on the cellulose acetate filaments and/or staple fibers immediately after the filter tow has been provided with a plasticizer or adhesive).

The invention will be explained more specifically hereinbelow with reference to the examples.

COMPARATIVE EXAMPLE

A cellulose acetate spinning solution of solid content of 28 mass-% cellulose acetate and 0.5 mass-% titanium dioxide in acetone was prepared. The water content of this spinning solution was adjusted to 3 mass-%.

The cellulose acetate used had an acetyl number of 55.4% and a degree of polymerization (DP) of 220. This spinning solution was filtered and spun by dry spinning on a conventional filter tow spinning installation. The formed cellulose acetate filaments were gathered to a band, crimped by means of a crimping machine under pressure, and dried. The resulting filter tow of cellulose acetate filaments was crimped in the crimping machine first deposited loosely by means of a packing machine and subsequently compressed to a bale; the bale had a residual moisture of 5.5 mass-%.

The specification of the filter tow thus produced was 3 Y 35 HK. This designation means

| | |
|---|---|
| filament titer | 3.3 dtex |
| total titer | 38,500 dtex. |

cross-sectional form of the cellulose acetate filaments: Y. The tear strength of the filter tow referred to the total titer of this filter tow was $4.3 \times 10^{-4}$ daN/dtex.

The above-mentioned filter tow was processed on a filter rod machine Model KDF 2/AF 2 of the firm Korber AG, Hamburg, Federal Republic of Germany, at a velocity of 400 m/min to filter rods of the following specification:

| | |
|---|---|
| length | 126 mm |
| diameter | 7.85 mm |
| draw resistance | 390 da Pa |
| weight of cellulose acetate | 690 mg |

In the production of these filter rods triacetin was applied as plasticizer for the cellulose acetate, namely so that the finished filter rods contained 55 mg triacetin per filter rod.

These filter rods were first shortened to a length of 84 mm on a laboratory filter applying machine Model Lab Max of the above-mentioned firm Korber AG, and subsequently coupled with a hank of tobacco of the type "American Blend" by the usual method using the aforesaid apparatus called Lab Max, resulting in the end in filter cigarettes with a filter length of 21 mm.

Of the filter cigarettes thus produced, groups of 20 were then smoked down in 10 cycles on a standard smoking machine Model RM 20 of the firm Borgwaldt, Hamburg, Federal Republic of Germany, according to CORESTA Standard (Method No. 23), with the following result:

| | |
|---|---|
| condensation | 18.4 mg |
| nicotine | 1.23 mg |
| condensation retention | 42.5% |

The smoked cigarette filters, from which tobacco residues and the various papers (cigarette paper, filter wrapping paper, tipping) were carefully removed, were weighed and singly sewed into a fine-meshed nylon net (polyamide net).

The same amount of unsmoked cigarette filters, also of a length of 21 mm, from which paper had been removed, was weighed and sewed into a fine-meshed nylon bag in the same manner.

The samples thus prepared were placed for 20 days into the activation basin (clarification basin) of the biological purification stage of a clarification plant.

After removal of the samples from the clarification basin, the cigarette filters were carefully washed with deionized water, dried, and weighed.

The average weight loss of the samples, referred to the quantity of cellulose acetate, was 8% (by independent tests it was found that the smoke deposited in the cigarette filters as well as the triacetin are completely degraded under the afore-mentioned conditions within 20 days; this was taken into account in calculating the cellulose acetate weight loss).

No significant difference in weight loss was observable between smoked and unsmoked cigarette filters.

EXAMPLE 1

The spinning solution was prepared as in the comparative example, except that first 1.5 mass-% of a finely screened (pore size of the sieve: 20/um) beta-lactoglobulin powder, produced by Bridel, France, was dispersed into the acetone.

This spinning solution was spun, as in the comparative example, to 50 kg filter tow of a tear strength, referred to the total titer thereof, of $2.9\times10^{-4}$ daN/dtex, the cellulose acetate filaments having again been crimped in the crimping machine under pressure and dried, and from the filter tow again filter rods and therefrom cigarette filters were produced and smoked down, as in the comparative example. The smoke-down results were as follows:

| | |
|---|---|
| condensation | 18.1 mg |
| nicotine | 1.25 mg |
| condensation retention | 42.0% |

As described in the comparative example, the biodegradability of the smoked and unsmoked cigarette filters was tested in the clarification basin of the clarification plant. These clarification basins always contain enough microorganisms of the kind which are able to convert the nitrogen from betalactoglobulin so that basic decomposition products are formed and hence a basic (alkaline) medium is created on the surface of the cellulose acetate filaments.

For the smoked as well as the unsmoked cigarette filters the weight loss referred to the quantity of cellulose acetate averaged 15% (in independent tests it was found that under the cited test conditions the beta-lactoglobulin degrades completely; this fact was taken into account in accordance with the procedure in the comparative example in addition to the correction for the complete degradation of the smoke and triacetin deposited in the cigarette filters).

EXAMPLE 2

A spinning solution as in the comparative example was prepared, but with the difference that first 1.5 mass-% urea was introduced into the acetone and dissolved at 60° C.

By means of this spinning solution, as in the comparative example, 200 kg filter tow were prepared from the crimping machine cellulose acetate crimped filaments, which again were processed to filter rods and finally to cigarette filters. The tear strength of the filter tow referred to the total titer was $3.5\times10^{-4}$ daN/dtex.

The smoking down of the filter cigarettes provided with these filters (see comparative example) gave the following results:

| | |
|---|---|
| condensate | 18.7 mg |
| nicotine | 1.20 mg |
| condensation retention | 42.1% |

As described in the comparative example and Example 1, the degradation test was carried out on the smoked and unsmoked cigarette filters in the clarification basin of the clarification plant.

The weight loss, referred to the quantity of cellulose acetate, averaged 10.5% for the smoked and unsmoked cigarette filter (in independent tests it was found that under the cited test conditions the urea biodegrades completely; in accordance with the procedure in the comparative example and in Example 1; this was again taken into account in calculating the weight loss in cellulose acetate in addition to the correction for the complete degradation of the smoke and triacetin deposited in the cigarette filters).

EXAMPLE 3

A spinning solution as in the comparative example was prepared, but with the difference that first 1.5 mass-% of hexamethylene tetramine was introduced and dissolved in the acetone.

Using this spinning solution, as in the comparative example, 200 kg filter tow was prepared cellulose acetate filaments in the crimping machine, which again was processed to filter rods and finally to cigarette filters. The filter tow had a tear strength, referred to the total titer, of $3.5\times10^{-4}$ daN/dtex.

The smoking down of the filter cigarettes provided with these filters (see comparative example) gave the following results:

| | |
|---|---|
| condensation | 18.3 mg |
| nicotine | 1.18 mg |
| condensation retention | 41.5% |

As described in the comparative example and in Example 1, the degradation test was carried out on the smoked and unsmoked cigarette filters in the clarification basin of the clarification plant.

The weight loss referred to the quantity of cellulose acetate averaged for the smoked and unsmoked cigarette filters 25% (in independent tests it was found that under the cited test conditions hexamethylene tetramine degrades completely; this was again taken into account in accordance with the procedure in the comparative example, in Example 1 and in Example 2, in calculating the weight loss in cellulose acetate in addition to the correction for the complete degradation of the smoke and triacetin deposited in the cigarette filters).

EXAMPLE 4

From the spinning solution according to the comparative example, a foil A of a thickness of 0.05 mm was poured.

With the spinning solution according to Example 1, a foil B, again 0.05 mm thick, was poured.

With the spinning solution according to Example 3, a foil C, again 0.05 mm thick, was poured.

Foils A, B and C were carefully washed with deionized water to remove any residual acetone still present.

As described in the control example, the testing of the biodegradation was carried out under controlled microbiological conditions.

Test of biodegradability under controlled microbiological conditions (control example)

To verify the acceleration of the biodegradation due to the characteristics according to the invention under defined microbiological conditions, a modified test method for water-insoluble samples was developed in analogy to the degradation test for water-soluble substances described in DIN 38 409 H52.

According to this modified test procedure, the microbiological degradation is determined by measuring the oxygen consumption of the microorganisms during the degradation process. The oxygen consumption is determined by pressure gauge. The carbon dioxide formed by the metabolism of the microorganisms is bound by sodium hydroxide and thus does not affect the pressure measurement.

In each test, 200 mg filter tow according to the comparative example and Examples 1, 2 and 3, as well as 200 mg of foils A, B and C according to Example 4 were introduced into a mineral nutrient solution. The soil bacteria needed for the microbiologic degradation were obtained from soil filtrate; the nutrient solutions were seeded with 2 ml each of this soil filtrate solution.

The percent loss of mass of the samples calculated from the oxygen consumption is listed in the following table.

| | % weight loss after days | | |
|---|---|---|---|
| | 20 | 40 | 60 |
| Filter tow according to the comparative example | 0.5 | 1.3 | 2.5 |
| Filter tow according to Example 1 | 7 | 13 | 21 |
| Filter tow according to Example 2 | 7 | 9 | 12 |
| Filter tow according to Example 3 | 9 | 25 | 48 |
| Foil A according to Example 4 | 0.3 | 1.0 | 1.9 |
| Foil B according to Example 4 | 4 | 8 | 12 |
| Foil C according to Example 4 | 5 | 12 | 24 |

In contrast to the procedure according to the comparative example and Examples 1, 2 and 3, no correction for the biodegradation of the respective additive was made in the calculation of these test results.

What is claimed is:

1. Filaments or staple fibers formed of cellulose acetate and at least one nitrogenous organic compound capable of forming under the action of microorganisms at least one of $NH_3$ or a basic compound containing at least one —NH or $NH_2$ group whereby a basic medium is formed and partial hydrolysis of said cellulose acetate occurs and wherein said at least one nitrogenous organic compound has been introduced into the cellulose acetate solution prior to the formation of said filaments and staple fibers.

2. Filaments or staple fibers according to claim 1 wherein said cellulose acetate is acetone soluble and has an acetyl number lower than 53%.

3. Filaments or staple fibers according to claim 2 wherein said cellulose acetate has an acetyl number between 50% and 52%.

4. A filter tow consisting of a band of a plurality of filaments or staple fibers or a mixture thereof formed of cellulose acetate and at least one nitrogenous organic compound capable of forming under the action of microorganisms at least one of $NH_3$ and a basic compound containing at least one —NH or $NH_2$ group whereby a basic medium is formed and partial hydrolysis of said cellulose acetate occurs, and wherein said at least one nitrogenous organic compound has been introduced into the cellulose acetate solution prior to the formation of said filaments and staple fibers.

5. The filter tow according to claim 4 wherein said at least one nitrogenous organic compound is urea, beta-lactoglobulin, hexamethylene tetramine or carbazole.

6. The filter tow according to claim 5 wherein said nitrogenous organic compound is hexamethylene tetramine.

7. The filter tow according to claim 4 wherein said filaments or staple fibers or mixtures thereof are crimped.

8. The filter tow according to claim 4 wherein said cellulose acetate is acetone soluble and has an acetyl number lower than 53%.

9. The filter tow according to claim 8 wherein said cellulose acetate has an acetyl number between 50% and 52%.

10. The filter tow according to claim 4 which has a tear strength referred to the total titer thereof at most $4\times10^{-4}$ daN/dtex.

11. A tobacco smoke filter element, consisting of a section of a transverse-axially compacted filter tow from cellulose acetate filaments or staple fibers or a mixture of filaments and staple fibers hardened by means of a plasticizer for cellulose acetate or an adhesive, wherein the filter tow is according to claim 4.

12. The tobacco smoke filter element according to claim 11 wherein less than one-half the surface of the cellulose acetate filaments or cellulose acetate staple fibers or both said cellulose and said staple fibers is provided with the plasticizer for cellulose acetate or with the adhesive.

13. The method of manufacturing a tobacco smoke filter element which consists of providing a filter tow according to claim 4 with a plasticizer for cellulose acetate or with an adhesive, subsequently transverse-axially compacting, wrapping said filter tow with a wrapping strip, cutting the filter tow thus compacted and wrapped into individual tobacco smoke filter rods, and finally cutting said tobacco smoke filter rods into individual tobacco smoke filter elements.

14. The tobacco smoke filter element according to claim 13 wherein said plasticizer for cellulose acetate is biodegradable and accelerates microbiological growth of the cellulose acetate filaments and cellulose acetate staple fibers and the adhesive is water-soluble and biodegradable.

15. The tobacco smoke filter element according to claim 14 wherein the adhesive is a starch glue or a polyvinyl acetate glue.

16. The tobacco smoke filter element according to claim 14 which contains the plasticizer for cellulose acetate in a quantity of at most 6 mass-% referred to the mass of the cellulose acetate filaments or to the mass of the cellulose acetate staple fibers or the mass of both said filaments and said staple fibers.

17. The method of manufacturing a filter tow which comprises the step of gathering a plurality of filaments or staple fibers, or a mixture of filaments and staple fibers, said filaments and staple fibers being formed from a cellulose acetate in which an additive is present, said additive consisting of at least one nitrogenous organic compound, said nitrogenous organic compound forming by degradation by microorganisms at least one of ammonia, basic organic compounds having at least one —NH group or at least one $NH_2$ group.

18. The method according to claim 17 wherein the filter tow consists of a plurality of filaments, said organic nitrogenous compound is added to a solution of cellulose acetate in acetone, said solution is then extruded through a multihole spinnerette whereby cellulose acetate filaments are spun, prior to gathering said filaments to form the filter tow.

19. The method according to claim 18 wherein said organic nitrogenous compound is introduced into said solution of cellulose acetate in acetone at 60° C.

20. The method according to claim 17 wherein the filter tow consists of staple fibers or a mixture of filaments and staple fibers, said filaments and staple fibers being formed from a cellulose acetate in which an additive is present, said additive consisting of at least one nitrogenous organic compound, said nitrogenous organic compound forming by degradation by microorganisms at least one of ammonia, basic organic compounds having at least one group —NH or at least one $NH_2$ group, said filaments are cut to staple fibers prior to gathering said staple fibers or said filaments and staple fibers to form the filter tow.

21. The method according to claim 17 wherein said filaments are cut to staple fibers prior to said step of gathering a plurality of said filaments.

* * * * *